United States Patent [19]

Walton

[11] 4,406,297

[45] Sep. 27, 1983

[54] PIPET WASHER

[76] Inventor: John R. Walton, 2558 Seahorse Ave., Ventura, Calif. 93001

[21] Appl. No.: 323,761

[22] Filed: Nov. 23, 1981

[51] Int. Cl.[3] ..... B08B 3/04; B08B 9/00

[52] U.S. Cl. ..... 134/102; 134/103; 134/107; 134/171

[58] Field of Search ..... 134/102–103, 134/107–108, 166 R, 166 C, 169 R, 171

[56] References Cited

U.S. PATENT DOCUMENTS

| | | | |
|---|---|---|---|
| 2,135,043 | 11/1938 | Seman | 134/102 X |
| 2,734,518 | 2/1956 | Harrison | 134/166 RX |
| 3,441,035 | 4/1969 | Edwards | 134/103 |
| 3,881,503 | 5/1975 | Fox et al. | 134/103 X |
| 4,268,156 | 5/1981 | Kostiner | 134/102 X |
| 4,345,609 | 8/1982 | Nishizawa | 134/171 X |

FOREIGN PATENT DOCUMENTS

| | | | |
|---|---|---|---|
| 146727 | 8/1954 | Sweden | 134/166 R |

*Primary Examiner*—Robert L. Bleutge

[57] ABSTRACT

A self-contained pipet washer and dryer which utilizes a container assembly within which is located a quantity of the pipets that are to be washed and dryed. An acid storage tank is included which includes a volume of acid which is to supply acid into the container to soak the pipets for a period of time. Tap water is to be supplied into the container to initially rinse the pipets after the acid soaking. A second source of rinsing solution, in the form of deionized water, is provided to function as a final rinse for the pipets. Heated air is to then be blown across the pipets to dry the pipets.

11 Claims, 13 Drawing Figures

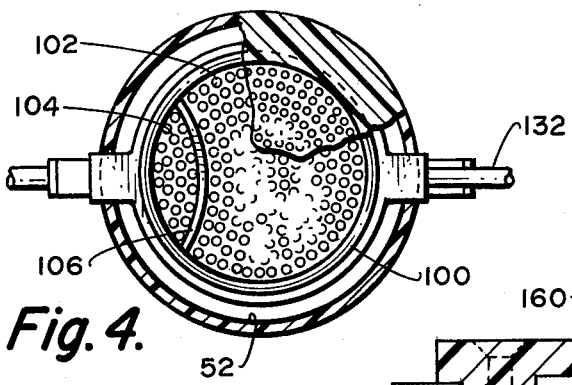
Fig. 4.
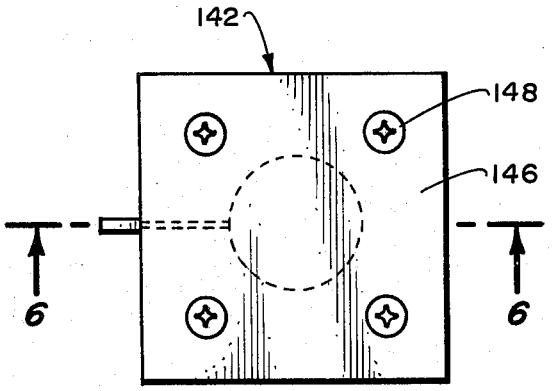
Fig. 5.
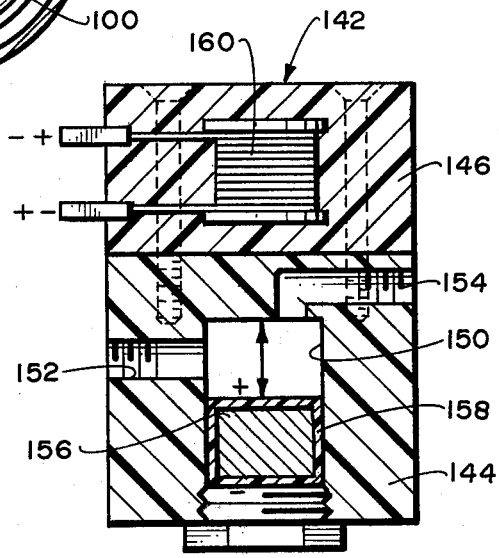
Fig. 6.
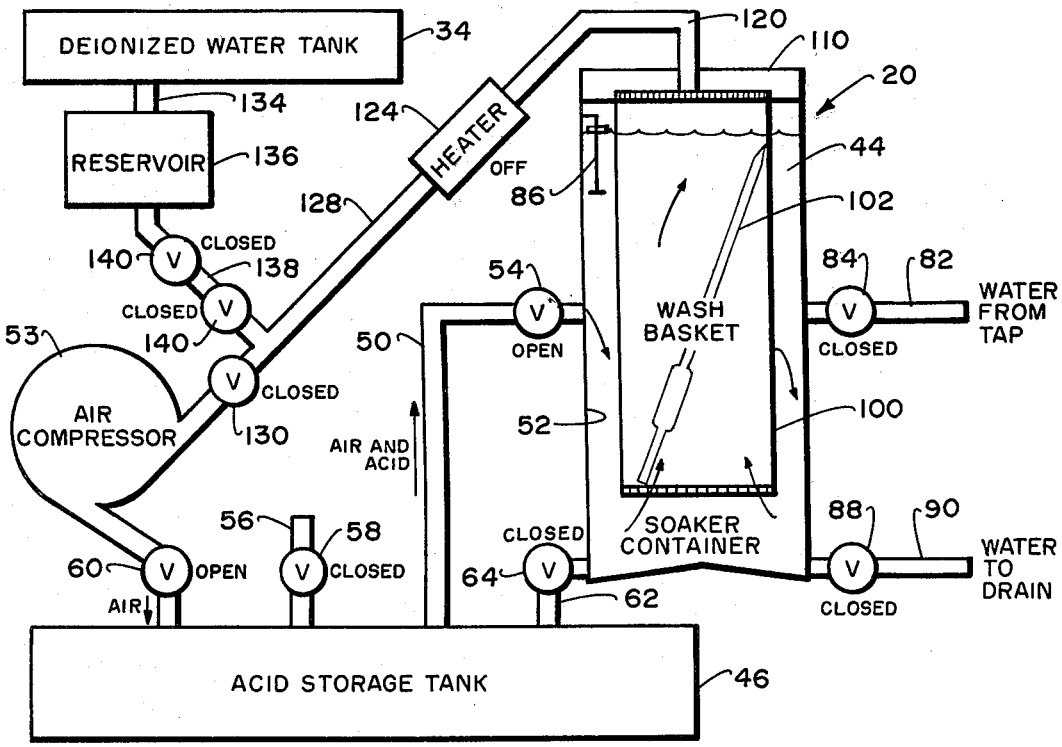
Fig. 7. ACID IN

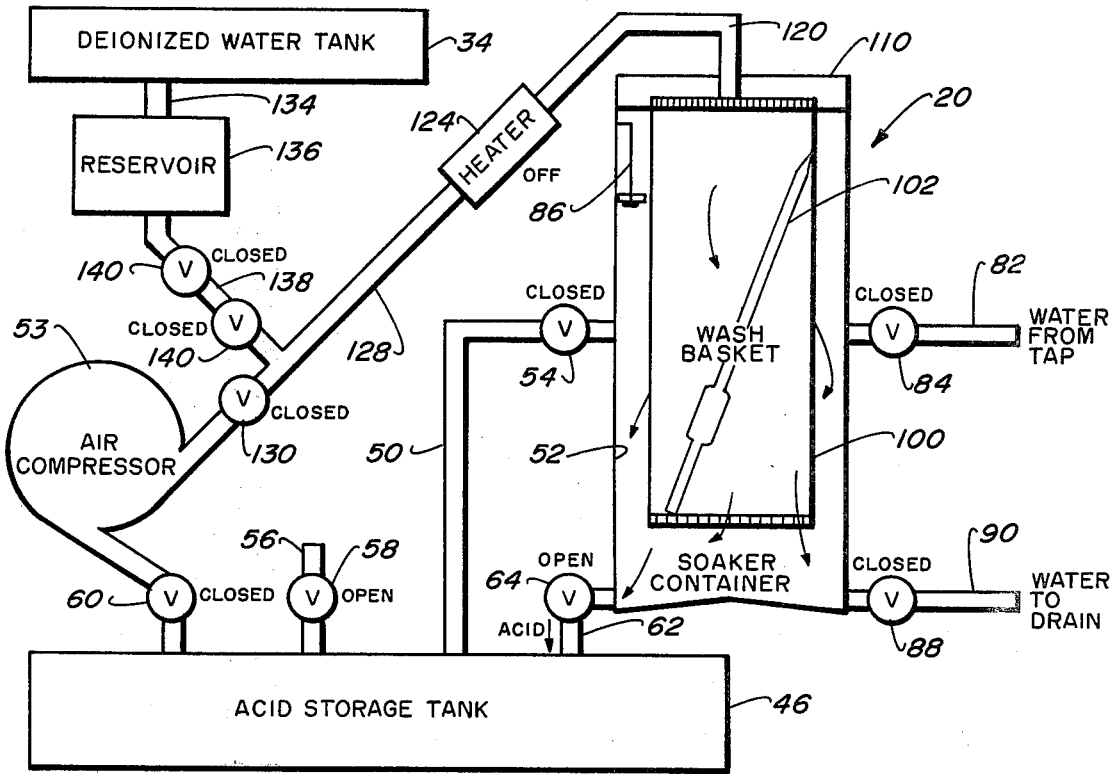
*Fig. 8.* ACID SOLUTION OUT
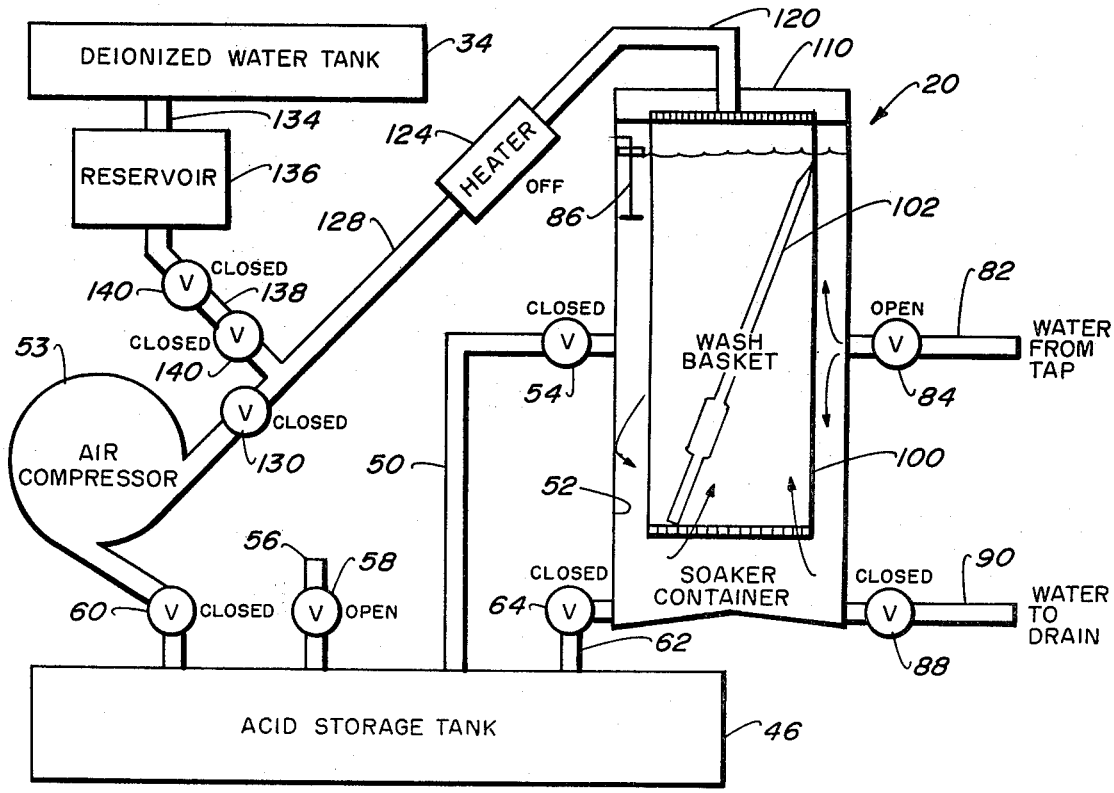
*Fig. 9.* WATER WASH IN

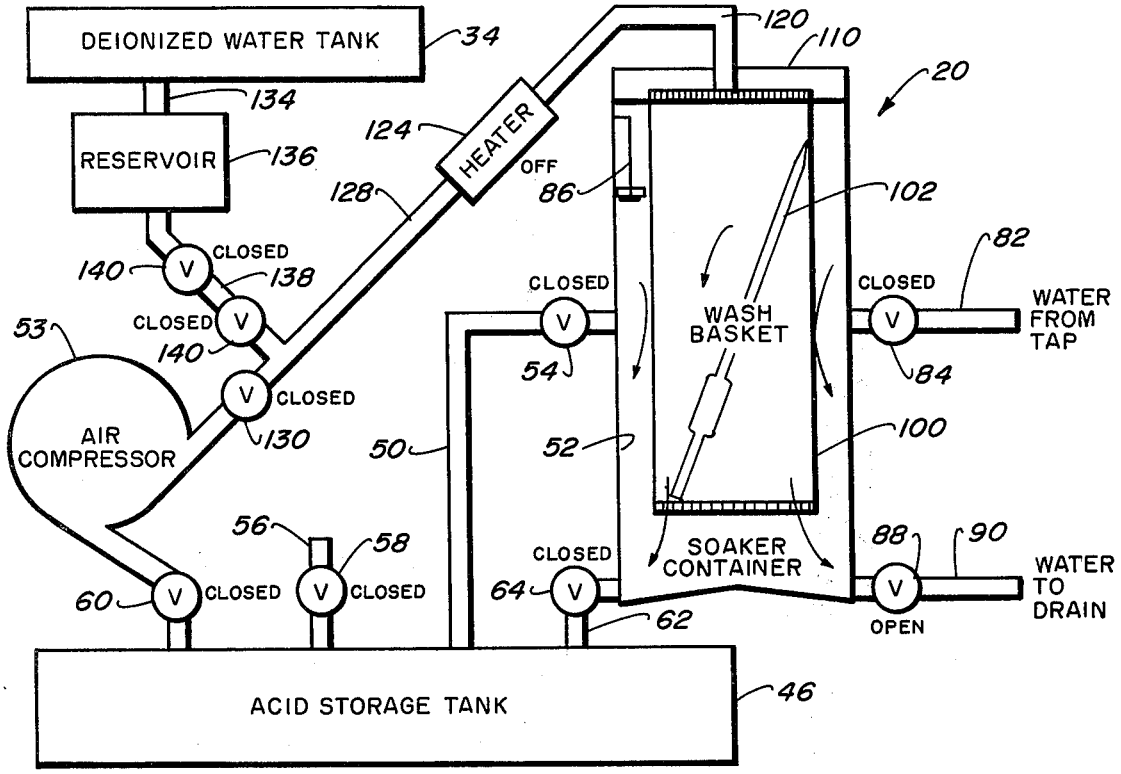
*Fig. 10.* WATER WASH OUT
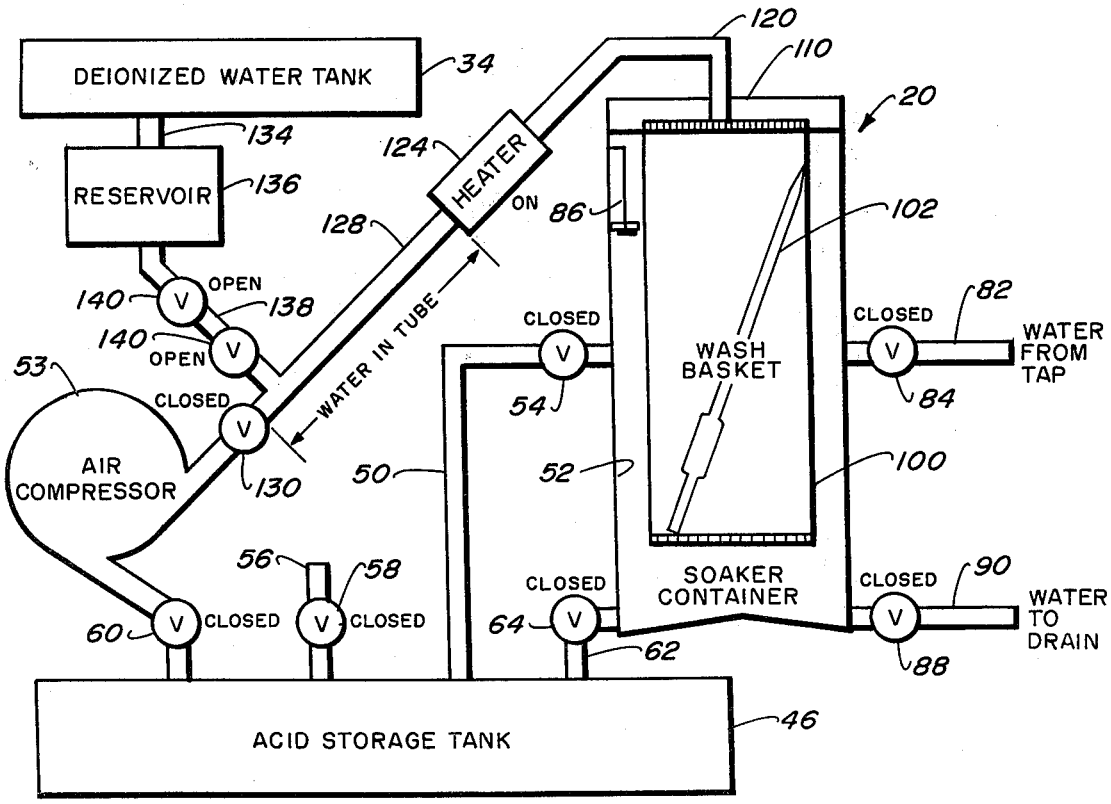
*Fig. 11.* DEIONIZED WATER FILL

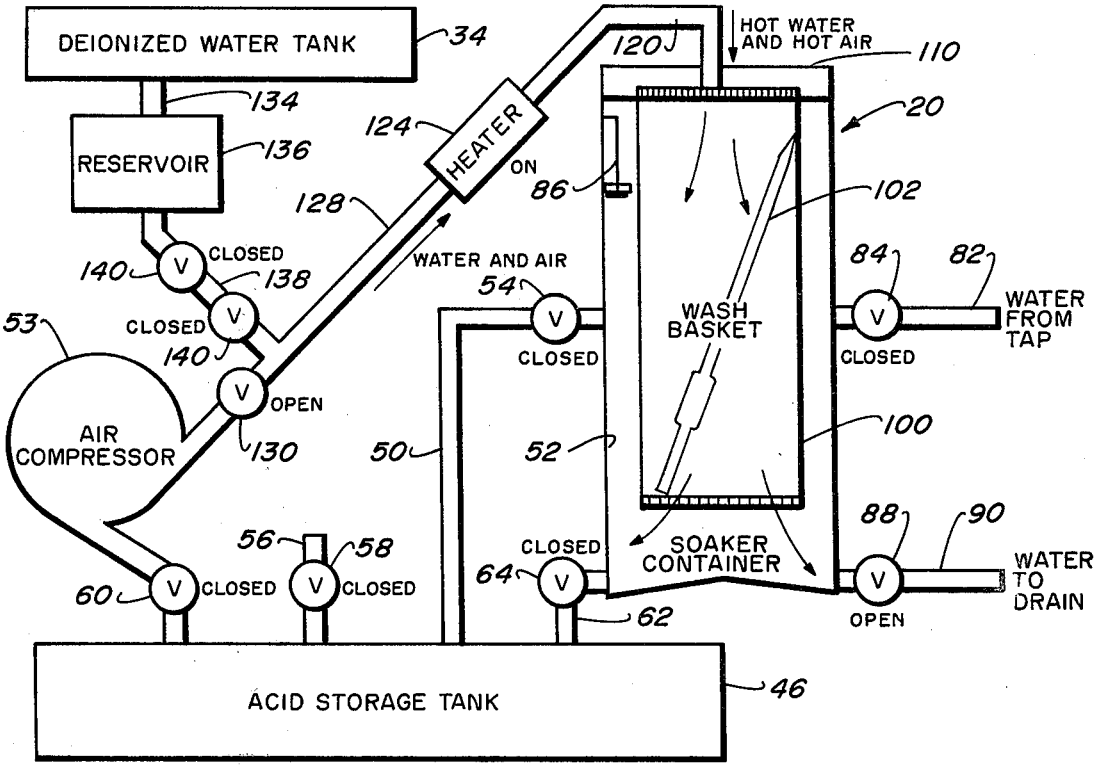
Fig. 12. DEIONIZED WATER IN
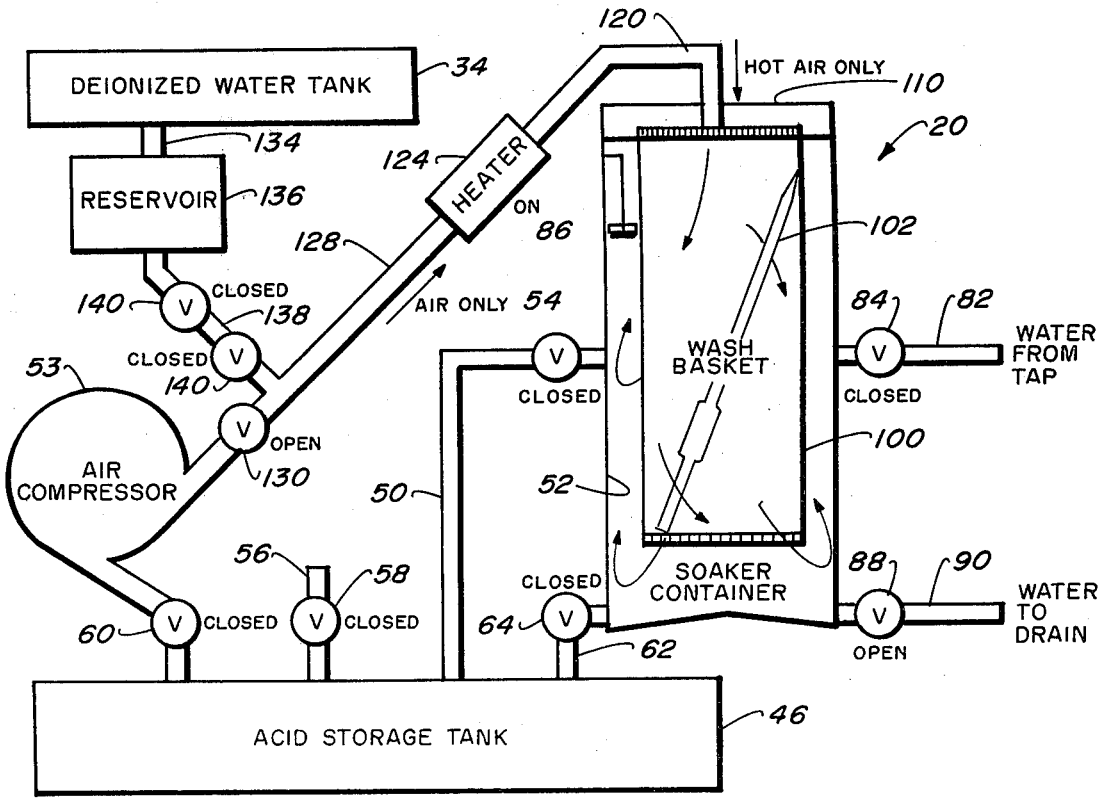
Fig. 13. HOT AIR ONLY

PIPET WASHER

BACKGROUND OF THE INVENTION

The field of this invention relates to a washing and drying apparatus for utensils, and more specifically to an automatic washing and drying apparatus for pipets.

Pipets are in common use in medical laboratories and other types of laboratories. One way in which a pipet is used is in the performing of blood tests. The pipet is used to remove precise volumetric amounts from a reagent or sample to then be transferred to a vial which contains certain substances for performing certain types of tests. Once the pipet has been used, it is normally set aside to be washer prior to its next usage.

Most pipets are constructed of glass. In order to prevent the possibility of contamination both to the user and the test reagents, the washing procedure for the pipets is quite extensive. The pipets are usually first soaked in a mild acid solution for a certain period of time, such as thirty minutes to one hour. A desirable type of acid solution would be sulfuric acid dichromate.

The normal procedure for washing pipets is to accumulate a substantial number (a days supply) and manually place the pipets within a container full of the acid solution. After the pipets have soaked for a reasonable period of time, the acid solution is drained and then the pipets are washed several times in tap water and then finally rinsed in deionized water. The pipets are then removed from the container and placed in an area to dry. It is not at all uncommon for the entire washing and drying procedure to take a period of several hours. In other words, within the laboratory, it is required that a single individual take three to four hours of time to properly wash and dry the pipets that have been used during the previous day.

There has long been a need to design an automatic washing and drying apparatus for pipets which would eliminate the hazardous and time consuming chore of washing and drying pipets. It is essential that pipets are scrupulously clean due to the possible health hazards associated with the testing of body fluids and common laboratory reagents.

SUMMARY OF THE INVENTION

The structure of this invention relates to a self-contained unit within which is located a washing and drying chamber. This washing and drying chamber has a removable basket. The pipets to be washed and dryed are to be located within the basket. The chamber is capable of being filled with an acid solution which is located within a storage reservoir mounted within the self-contained unit. After the pipets have been soaked in the acid solution for the desired period of time, the acid solution is drained from the chamber back into the storage reservoir. The chamber is then filled and drained a plurality of times with conventional tap water. This functions as the beginning of the rinse cycle for the pipets. After this initial rinse cycle, the pipets are sprayed a plurality of times with a measured quantity of deionized water. Normally this deionized water is heated. After this final rinse cycle, the pipets are dried by being subjected to a continuous blast of heated air. The air is supplied from an air compressor. The air compressor also functions to pump the acid into the chamber as well as pumping of the deionized water into the chamber. A novel valve is utilized in conjunction with conduits through which the acid is moved to and from the chamber. This valve is deemed to be substantially acid resistant. The valve includes a valve chamber within which is located a valve spool. The valve spool is movable in between an open position permitting the acid to flow through the chamber and a closed position preventing the flow of acid through the chamber. The valve spool comprises a ceramic magnet which has been exteriorly coated with a plastic. A desirable type of plastic would be what is commonly sold under the trade name of TEFLON. The valve spool is moved by activation of an electromagnet which has been mounted in conjunction with the valve.

The primary objective of this invention is to construct a pipet washing and drying apparatus which can be used in laboratories to automatically wash and dry a quantity of pipets, leaving the pipets totally free of foreign material which could contaminate and produce false results in the preforming of certain tests.

BRIEF DESCRIPTION OF THE DRAWINGS

FIG. 4 is a top, plane view, partly in cross-section, of the container assembly utilized in conjunction with the pipet washer and dryer apparatus of this invention taken along line 4—4 of FIG. 3;

FIG. 5 is a top, plan view of the valve which is utilized in conjunction with the conduits through which the soaking acid solution is conducted;

FIG. 6 is a cross-sectional view through the valve taken along line 6—6 of FIG. 5;

FIG. 7 is a diagramatic view of the washer dryer apparatus of this invention showing the apparatus in the operational mode of soaking the pipets in the acid solution;

FIG. 8 is a view similar to FIG. 7 but showing the apparatus in the position removing the acid solution from the soaking chamber;

FIG. 9 is a view similar to FIG. 8 showing the apparatus in the initial rinsing position utilizing tap water within the soaking chamber;

FIG. 10 is a view similar to FIG. 9 showing the removing of the initial rinse water;

FIG. 11 is a view similar to FIG. 10 showing the supplying of a metered amount of finalized rinse water in position to be supplied into the soaking chamber;

FIG. 12 is a view similar to FIG. 11 showing the supplying of a metered amount of finalized rinse water into the soaking chamber; and FIG. 13 is a view similar to FIG. 12, showing the applying of heated air into the soaking chamber.

DETAILED DESCRIPTION OF THE SHOWN EMBODIMENT

Figure 1:
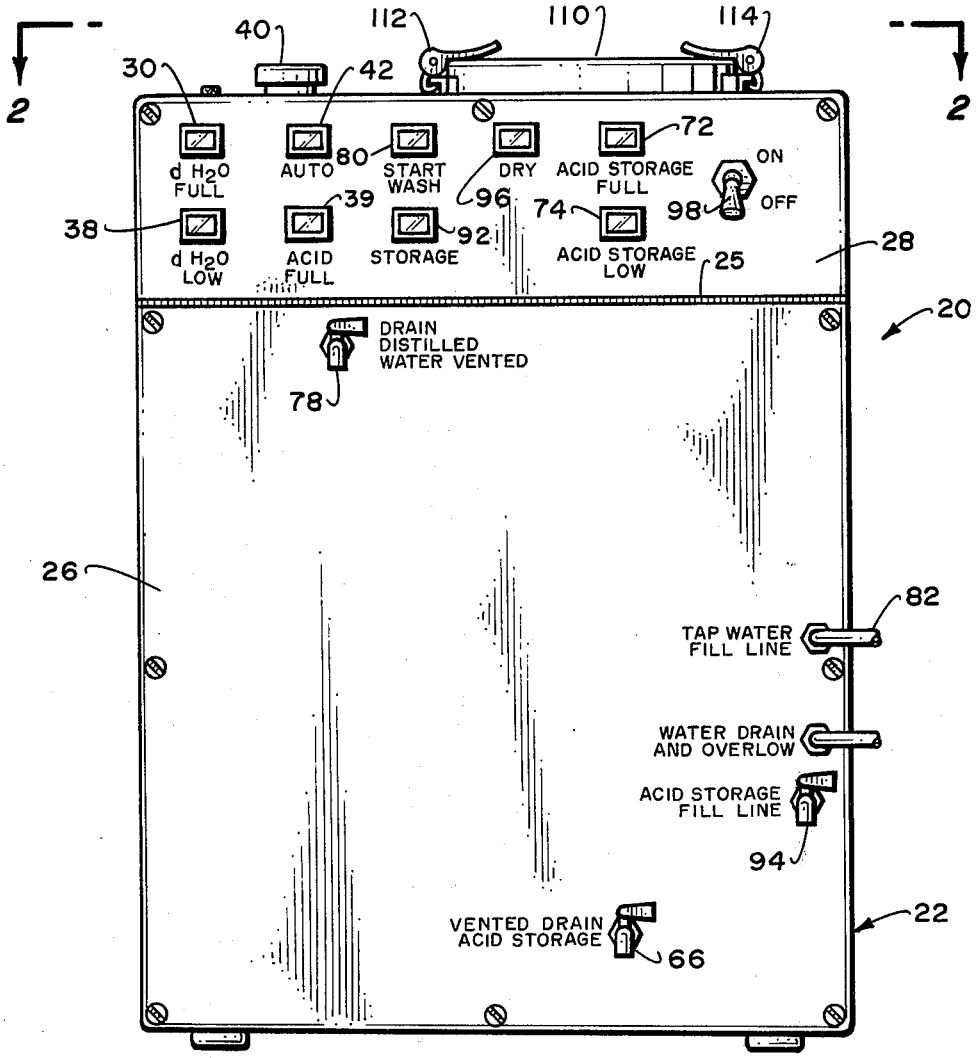
FIG. 1 is a front, elevational view of the pipet washer and dryer apparatus of this invention.
Figure 2:
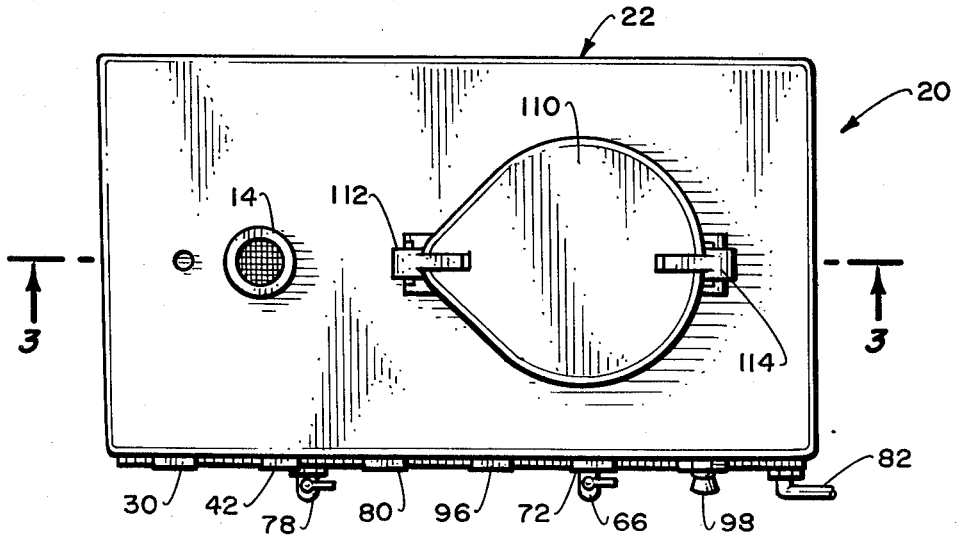
FIG. 2 is a top plan view of the pipet washer and dryer of this invention taken along line 2—2 of FIG. 1.
Figure 3:
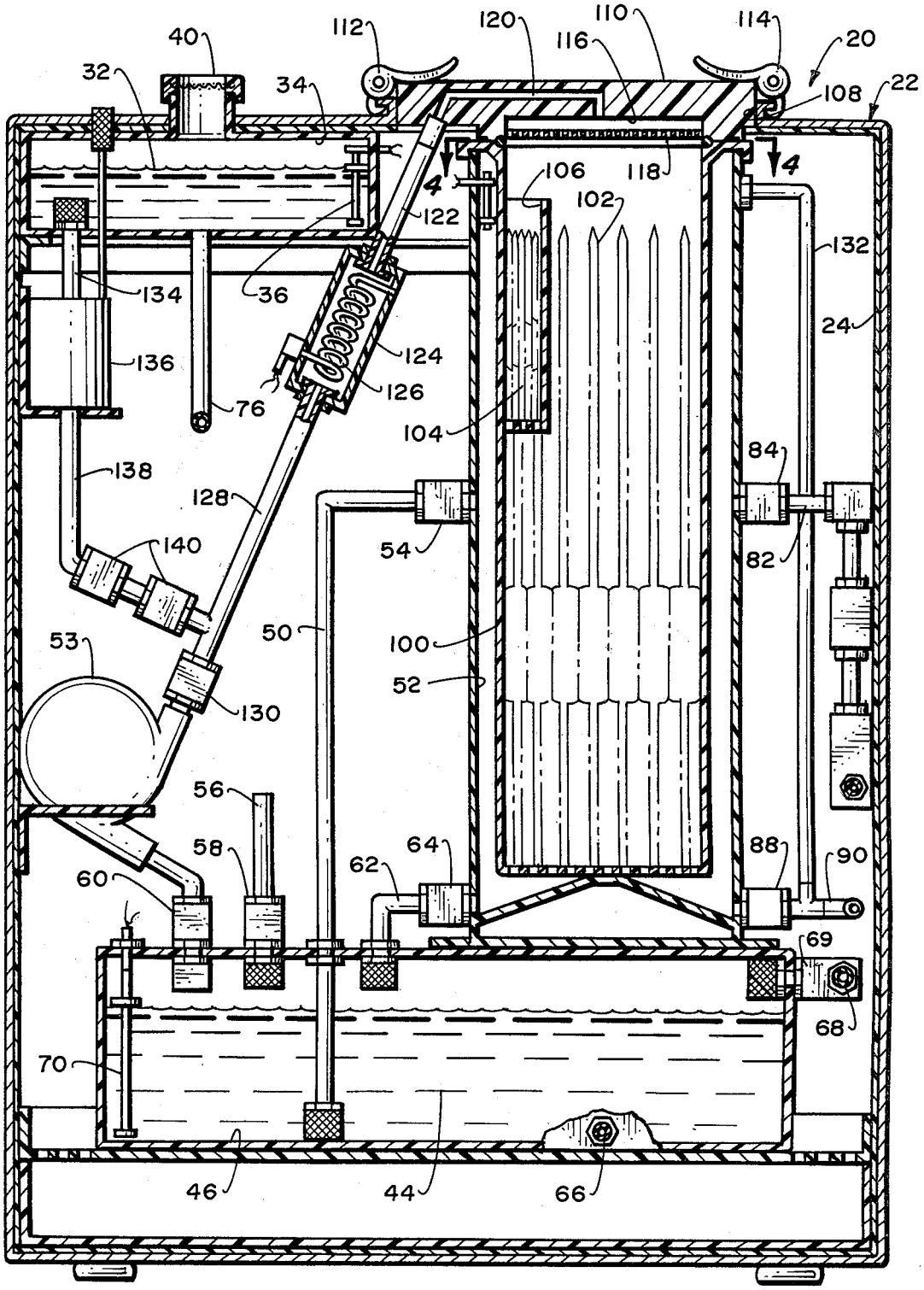
FIG. 3 is a cross-sectional view through the pipet washer and dryer apparatus of this invention taken along line 3—3 of FIG. 2.

Referring particularly to the drawings, there is shown the pipet washer and dryer 20 of this invention which is shown mounted contained within a housing 22. The housing 22 is basically box-like in configuration and includes an enlarged internal compartment 24. Within the front portion of the housing 22 there is located a removable front wall 26. The removable front wall 26 is in order to gain access into the internal compartment 24 for reasons for maintenance and repair.

Also formed within the front wall of the housing 20 and located above the removable wall 26 is a panel 28. Within the panel 28 are located a series of buttons and indicator lights which are to be connected to an electrical regulator (not shown). Indicator light 30 is to indicate if the deionized water 32 within the tank 34 is at the full level. This indication is given through flow switch mechanism 36 mounted within the tank 34. Indicator light 38 is to indicate if the water level of the deionized water 32 is at a low level requiring the operator to add additional deionizing water into the tank 34 through the inlet 40. The panel 28 and removable wall 26 are hinged together by hinge 25.

If the operator manually pushes button 42, the acid solution 44 located within the acid tank 46 is to be moved through conduit 50 to fill the soaker container 52. The acid is moved through the conduit 50 into the soaker container 52 by means of air pressure being applied to the surface of the acid solution 44. This air pressure is supplied by electrically activating air compressor 53.

Located within the conduit 50 is a check valve 54 which permits liquid to be conducted to the conduit 50 only in the direction into the soaker container 52. During the pumping of the acid solution 44 from the tank 46, the atmospheric vent 56 of the tank 46 is closed by means of valve 58. The air pressure from the air compressor 53 is permitted to be conducted into the acid tank 46 when the valve 60 opens.

The soaker container 52 is connected to an acid solution drain conduit 62. The acid drain conduit 62 is closed by a valve 64 during the supplying of the acid solution 44 into the soaker container 52. It can be seen by the drawings that when the acid solution 44 is drained from the soaker container 52, that it is conducted back into the acid storage tank 46. This is so that the acid solution 44 can be used a plurality of times and does not need to be replaced every time. When it is desired to replace the acid solution 44, such is to be drained through manually operated and vented drain valve 60. New acid solution 44 is to be conducted into the tank 46 by means of a conduit 68 and check valve. Pump 69 is actuated by switch 39 on panel 28. Switch 39 also opens atmospheric vent 56 by means of valve 58. When storage full light 72 is activated, switch 39 is automatically deactivated as is the valve 58 closing atmospheric vent 56.

Also located within the acid storage tank 46 is a float switch mechanism 70. This switch mechanism controls indicator lights 72 and 74 to indicate to the operator whether the amount of acid solution 44 is at a high level or a low level. The indicator lights 72 and 74 are located on the panel 28.

If for any reason it is desired to drain the deionized water 32 from the tank 34, there is provided a drain conduit 76 and a drain valve 78. Drain valve 78 is mounted within the removable front wall 26.

Upon activation of the button 80, the valve 64 is opened and the acid solution 44 within the tank 52 is emptied into the acid storage tank 46. After all the solution 44 has been emptied back into the tank 46, the valve 64 closes and tap water is then supplied from conduit 82 by opening of valve 84. Tap water is permitted to completely fill the soaker container 52 and upon reaching the full level, the float indicator mechanism 86 closes the valve 84 not permitting any more tap water to enter within the soaker container 52.

After a period of time, the regulator (not shown) will automatically open valve 88 to permit the tap water to be drained through the vented drain conduit 90 and to be discharged by any desirable manner.

The button 92, when activated, activates the pump 68, which is to supply the acid solution 44 into the tank 46 from the source (not shown). The operator is to activate the button 92 when the indicator light 74 shows that the level of the acid solution 44 is low. The acid solution is to be supplied through a valve 94 into the tank 46.

Also mounted within the panel 28 is an indicator light 96. The light 96 functions to indicate that the drying cycle is activated.

Also mounted within the panel 28 is an on-off switch 98 which is for the purpose of either activating or deactivating the entire pipet washer and dryer 20 of this invention. The soaker container 52 has mounted therein a basket 100. The basket 100 will normally be constructed of a rigid material such as plastic or metal. Within the basket 100 there is to be placed a quantity of elongated pipets 102. Smaller, shortened pipets 104 can be located within small compartment 106 of basket 100.

The basket 100 can be removed from the soaker container 52 through access opening 108. The access opening 108 is normally closed by means of a lid 100. The lid 110 is normally closed onto the housing 22 by means of latches 112 and 114.

Formed within the inner surface of the lid 110 is a dispersing chamber 116. The exterior surface of the dispersing chamber 116 is closed by a dispersing screen 118. The function of the screen 118 is that it is of a sufficiently small mesh so that when liquid is supplied into the dispersing chamber 116 that it will be substantially evenly distributed across the screen 118 prior to entry into the soaker container 52. Liquid is supplied into the dispering chamber 116 through conduit 120 formed within the lid 110. The conduit 120 terminates in a nipple which in turn is connected to a flexible hose 122. Flexible hose 122 is connected to the wall of the heater chamber 124. Within the heater chamber 124 is located an electrical heating coil 126. The free end of the heater chamber 124 is connected to a conduit 128, through a valve 130 to the air compressor 52.

If, per chance, the soaking container 52 starts to overfill, as from tap water from the conduit 82, there is provided an overfill conduit 132 which is to conduct the excess water into drain conduit 90.

The deionized water 32 is to be conducted through conduit 134 into a small reservoir 136. From the reservoir 136, the deionized water is to flow through conduit 138 through a valve assembly 140 to then be discharged into the conduit 128.

Referring particularly to FIGS. 5 and 6, there is shown a novel type of valve 142. The valve 142 is constructed of a lower block 144 and an upper block 146. The upper block 146 is fixedly mounted to the lower block 144 by means of conventional threaded fasteners 148. Both the blocks 144 and 146 will be constructed of substantially the same material and will normally comprise an acid resistant material, such as a plastic.

Within the block 144 is located an enlarged chamber 150. Inlet conduit 152 connects with the chamber 150, and an outlet conduit 154 extends from the chamber 150. Movably mounted within the chamber 150 is a valve spool 156. The valve spool 156 is to be constructed of a magnetizable material. The valve spool 156 is coated with a plastic 158.

Mounted within the block 146 is an electromagnetic coil 160. It is to be understood by supplying of a sufficient electrical energy to the coil 160 that the valve spool 156 will be moved into the upper portion of the chamber 150 thereby preventing liquid from being conducted from conduit 152 into conduit 154. This in essence closes the valve 142. Reversing of the magnetic field within the coil 160 or possibly eliminating of the magnetic field will cause the valve spool 156 to be moved to the lower position shown in FIG. 6. Therefore, this permits liquid to be conducted from the conduits 152 into conduit 154.

Because of the acidic nature of the solution 44, it is desirable that the valves 54 and 64 be constructed as per valve 142 to minimize corrosion. Also, the valves 58, 60, 84 and 88 may also be constructed in this manner.

The operation of the pipet washer and dryer 20 of this invention is as follows: The pipets that are desired to be washed are located within the basket 100. The basket 100 is located within the soaker container 52 and the lid 110 is located tightly about access opening 108. As previously mentioned, the operator then manually presses button 42. This activates the air compressor 53, as well as closes valve 58, opens valve 60 and opens valve 54. Also, valves 64, 88, 84, 140 and 130 are closed. The heater 124 is inoperative. The air pressure from the air compressor 53 is transmitted into the acid storage tank 46 which causes the acid solution 44 to substantially completely fill the soaker container 52. When the container 52 has been sufficiently filled, the air compressor 53 is deactivated by float indicator mechanism 86. The acid solution 44 remains within the soaker container 52 for a period of time, such as thirty minutes to an hour.

When the operator decides that it is time to proceed with the remaining cycles of the pipet washer dryer 20 of this invention, the operator pushes button 80. This initially open valves 64 and valve 58. The acid solution 44 is permitted to flow back into the acid storage tank 46. At this particular time, the valve 64 then closes with valve 84 being opened permitting tap water to flow and completely fill the soaker container 52. When the soaker container 52 is completely filled, the float indicator 86 causes the valve 84 to close. Usually, the tap water will be located within the soaker container 52 for a short period of time, such as two minutes.

At the end of the two minutes time, the valve 88 will be caused to open permitting the tap water to be discharged through the drain conduit 90. In actual practice, this filling of the soaker container 52 with the tap water and discharging it will continue for approximately two hours.

The final rinse cycle begins with valves 84 and 88 being closed and valve 140 opened. This causes a metered amount of deionized water to flow from the reservoir 136 into the conduit 138. Heater 124 is activated. After the conduit 128 contains the metered amount of deionized water, the valve 140 is closed. The reservoir 136 begins to fill again from the deionized water tank 34. The air compressor 53 is activated and valve 130 is opened. As a result, the deionized water is moved through and heated by the heater 124, through conduit 120, through the dispersing chamber 116 and the dispersing screen 118 to be dispersed as a forceful mist into the soaker basket 100. This procedure is repeated for a plurality of times, usually three in number.

Referring particularly FIG. 13, there is shown the drying cycle wherein the valve 140 is closed. The air compressor 52 is operated continuously in this cycle. The valve 130 is open, as well as the heater 124 being activated. As a result, heated air is being conducted within the soaker basket 100. The outlet for the heated air is to be conducted through the valve 88 to be discharged through the drain conduit 90. This drying cycle continues usually for an extended period of time in order to insure that the pipets 102 and 104 will be substantially completely dried.

After the pipets have been completely dried, the switch 98 is moved to the off position, the lid 110 removed and the basket 100 removed from the soaker container 52. The washed and now dried pipets 102 and 104 are to be removed from the basket 100 and utilized in the desired manner. Instead of the lid 110 being completely removable, the lid 110 may be hinged to housing 22.

Although this invention has been described as being used with only an acid solution, it is to be within the scope of this invention to substitute a detergent solution for the acid solution.

What is claimed is:

1. A pipet washer and dryer comprising:

a container assembly adapted to contain a quantity of pipets to be washed;

an acid storage tank for containing a volume of liquid acid solution, said acid storage tank being capable of conducting said acid solution into said container assembly and from said container back into said acid storage tank;

a first source of rinsing solution connected to said container assembly, said first source to supply said rinsing solution into said container substantially filling said container assembly and then to be drained from said container assembly; and a second source of rinsing solution connected to said container assembly, said second source of rinsing solution to function as a final rinse into said container assembly and is to then be drained therefrom.

2. The pipet washer and dryer as defined in claim 1 including:

heater means for raising the temperature of said second source of rinsing solution.

3. The pipet washer and dryer as defined in claim 2 including:

pump means for conducting of said second source of rinsing solution into said container assembly.

4. The pipet washer and dryer as defined in claim 3 wherein:

said pump means comprising an air compressor, said air compressor to also be utilized to move air through said container assembly to effect drying within said container assembly.

5. The pipet washer and dryer as defined in claim 4 wherein:

said air compressor also functioning to move said liquid acid solution from said acid storage tank into said container.

6. The pipet washer as defined in claim 1 wherein:

a housing, said container assembly being mounted within said housing, said acid storage tank being mounted within said housing, said second source of rinsing solution being confined in a reservoir within said housing, regulator means mounted within said housing, said regulator means to function to discharge from said reservoir a precise quantity of said second source of rinsing solution to be then dispensed into said container assembly, said regulator means functioning to dispense a plurality of separate amounts of said second rinsing solution into said container assembly.

7. The pipet washer and dryer as defined in claim 6 wherein:

a primary liquid inlet mounted within said housing connecting with said container assembly, a dispersing screen connected to said housing and mounted directly adjacent said primary liquid inlet, the liquid entering said container from said primary liquid inlet is to be conducted through said dispersing screen prior to entry into said container assembly to be substantially evenly distributed across said container assembly.

8. The pipet washer and dryer as defined in claim 7 wherein:

said housing includes a lid, said lid being movable between an open position and a closed position in respect to said housing, with said lid in said open position access is provided into said container assembly, said primary liquid conduit being connected to said lid, said dispersing screen being mounted within said lid.

9. The pipet washer and dryer as defined in claim 8 wherein:

said container assembly including a basket, said basket to be removable from said housing and be spaced therefrom.

10. The pipet washer and dryer as defined in claim 1 wherein:

said liquid acid solution to be conducted through said primary liquid conduit into said container assembly, said primary liquid conduit including a valve, said valve including a valve spool which is to be movable from a position closing said conduit to a position opening said conduit, said valve spool being movable by magnetic force.

11. The pipet washer and dryer as defined in claim 1 including:

acid pump means for supplying said liquid acid solution into said acid storage tank.

* * * * *